US009506361B2

(12) United States Patent
Fielding et al.

(10) Patent No.: US 9,506,361 B2
(45) Date of Patent: Nov. 29, 2016

(54) LOW PROFILE VANE RETENTION

(71) Applicant: PRATT & WHITNEY CANADA CORP., Longueuil (CA)

(72) Inventors: Bruce Fielding, Glen Williams (CA); Nathan Tomes, Toronto (CA); Thomas Veitch, Scarborough (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 638 days.

(21) Appl. No.: 13/789,756

(22) Filed: Mar. 8, 2013

(65) Prior Publication Data

US 2014/0255179 A1 Sep. 11, 2014

(51) Int. Cl.
*F01D 9/04* (2006.01)
*F01D 25/24* (2006.01)

(52) U.S. Cl.
CPC ..... *F01D 9/041* (2013.01); *F01D 9/042* (2013.01); *F01D 25/246* (2013.01); *F05D 2260/12* (2013.01); *Y10T 29/4995* (2015.01)

(58) Field of Classification Search
CPC .. F01D 9/00; F01D 9/02; F01D 9/04–9/044; F01D 25/24–25/246; F01D 25/265
USPC ..... 415/189, 190, 191, 209.3, 209.4, 210.1
See application file for complete search history.

(56) References Cited

U.S. PATENT DOCUMENTS 2,812,158 A 11/1957 Byron
3,326,523 A * 6/1967 Bobo ..... 415/209.3
3,338,508 A * 8/1967 Castle et al. ..... 415/209.1
3,365,173 A * 1/1968 Lynch et al. ..... 415/209.3
3,997,280 A 12/1976 Germain
4,014,627 A * 3/1977 Heurteux ..... 415/189
4,245,954 A 1/1981 Glenn
4,868,963 A * 9/1989 Corsmeier ..... F01D 9/04 29/450
4,897,021 A 1/1990 Chaplin et al.
5,129,783 A 7/1992 Hayton
5,333,995 A 8/1994 Jacobs et al.
5,429,479 A 7/1995 Cordier
5,494,404 A 2/1996 Furseth et al.
5,547,342 A 8/1996 Furseth et al.
5,569,019 A 10/1996 Katariya et al.
5,681,142 A 10/1997 Lewis
5,846,050 A 12/1998 Schilling
6,296,443 B1 10/2001 Newman et al.
6,595,747 B2 7/2003 Bos
6,969,239 B2 11/2005 Grant et al.
7,628,578 B2 12/2009 Barnett et al.
7,637,718 B2 12/2009 Barnett et al.

(Continued)

FOREIGN PATENT DOCUMENTS

EP 1790827 4/2009

*Primary Examiner* — Thomas Denion
*Assistant Examiner* — Laert Dounis
(74) *Attorney, Agent, or Firm* — Norton Rose Fulbright Canada LLP

(57) ABSTRACT

A gas turbine having an annular casing with a series of circumferentially spaced openings defined therethrough; a plurality of vanes extending radially inwardly though respective casing openings, an outer end of the vanes projecting radially outwardly from the casing through the respective openings and located within the respective openings by grommets, and an inner end of the vanes being mounted to an inner portion of the casing; a flexible, segmented strap extending around the annular casing, surrounding the projecting outer ends of the vanes; and a spring radially loading the flexible strap configured to apply a tension force to the flexible strap.

15 Claims, 5 Drawing Sheets

(56) References Cited

U.S. PATENT DOCUMENTS

| | | | | |
|---|---|---|---|---|
| 7,824,152 | B2 | 11/2010 | Morrison | |
| 8,096,746 | B2 | 1/2012 | Durocher et al. | |
| 8,100,634 | B2 | 1/2012 | Evans | |
| 8,182,213 | B2 | 5/2012 | Cheung | |
| 8,206,100 | B2 | 6/2012 | Schuler et al. | |
| 8,398,366 | B2 * | 3/2013 | Twell | F01D 25/246 415/209.2 |
| 8,696,311 | B2 | 4/2014 | Eleftheriou et al. | |
| 8,899,914 | B2 * | 12/2014 | Ring | 415/119 |
| 8,998,574 | B2 | 4/2015 | Menheere et al. | |
| 2007/0098548 | A1 * | 5/2007 | Barnett et al. | 415/209.3 |
| 2010/0272565 | A1 | 10/2010 | Cheung | |
| 2012/0082553 | A1 | 4/2012 | Eleftheriou et al. | |
| 2012/0082556 | A1 | 4/2012 | Macchia et al. | |
| 2012/0251313 | A1 | 10/2012 | Eleftheriou et al. | |
| 2013/0058771 | A1 | 3/2013 | Menheere et al. | |

* cited by examiner

LOW PROFILE VANE RETENTION

TECHNICAL FIELD

The described subject matter relates generally to gas turbine engines, and more particularly to a stator vane restraining apparatus provided therein.

BACKGROUND OF THE ART

Gas turbine engine vane assemblies, such as those provided downstream of the engine fan, may have slots defined through the outer engine case for receiving and retaining the outer ends of the vanes in place. A grommet may be inserted in each of the slots to surround and isolate the respective vane from the shroud. However, during a foreign object damage event, a damaged vane can cut the grommet and cause damage to other surrounding components. An adhesive such as a potting compound is sometimes used, either in conjunction with or as a replacement for the grommet, but the use of such an adhesive generally complicates the installation and replacement of vanes.

Retaining straps have been developed but they are bulky and are not conducive to a confined space.

Accordingly, there is a need to provide an improved stator vane restraining apparatus for gas turbine engines, particularly when faced with a confined space.

SUMMARY

In one aspect there is provided a gas turbine engine having an annular casing with a series of circumferentially spaced openings defined therethrough; a plurality of vanes extending radially inwardly through respective casing openings, an outer end of the vanes projecting radially outwardly from the casing through the respective openings and located within the respective openings by grommets, and an inner end of the vanes being mounted to an inner portion of the casing; a flexible, segmented strap extending around the annular casing surrounding the projecting outer ends of the vanes; and a spring radially loading the flexible strap configured to apply a tension force to the flexible strap.

In another aspect there is provided a gas turbine engine having an annular casing with a series of circumferentially spaced openings defined therethrough; a plurality of vanes extending radially inwardly through respective casing openings, an outer end of the vanes projecting radially outwardly from the casing through the respective openings and located within the respective openings by grommets, and an inner end of the vanes being mounted to an inner portion of the casing; a flexible strap extending around the annular casing surrounding the projecting outer ends of the vanes; the improvement comprising a spring strip including an elongated web in the form of a circumferential ring and a plurality of laterally extending spring fingers projecting over the web in an alternating fashion from either edge of the web radially loading the flexible strap configured to apply a tension force to the flexible strap.

In a further aspect there is provided a vane retention apparatus for retaining an array of radially extending stator vanes arranged and protruding from an annular casing in a gas turbine engine; comprising a flexible, segmented strap extending around the annular casing surrounding the vanes; and a spring radially loading the flexible strap configured to apply a tension force to the flexible strap.

In a still further aspect there is provided a vane retention apparatus for retaining an array of radially extending stator vanes arranged and protruding from an annular casing in a gas turbine engine; comprising a flexible strap extending around the annular casing surrounding the vanes; the improvement comprising a spring strip including an elongated web in the form of a circumferential ring and a plurality of laterally extending spring fingers projecting over the web in an alternating fashion from either edge of the web radially loading the flexible strap configured to apply a tension force to the flexible strap.

In a still further aspect there is provided a method of retaining vanes in a gas turbine engine case, the case having a plurality of slots circumferentially distributed therearound, the vanes extending radially through each slot such that an end of the vane projects outwardly from the slot, the method comprising steps of placing a flexible strap made of a plurality of strap segments around the case to thereby surround the vane ends; joining the ends of the strap segments to provide a continuous strap and placing a circumferentially continuous spring strip between the strap and the case to apply a tension force on the flexible strap to tension the strap causing the spring strip and the strap to radially inwardly press the respective vanes in position.

Further details of these and other aspects of the described subject matter will be apparent from the detailed description and drawings included below.

DESCRIPTION OF THE DRAWINGS

Reference is now made to the accompanying figures in which.

DETAILED DESCRIPTION

Figure 1:
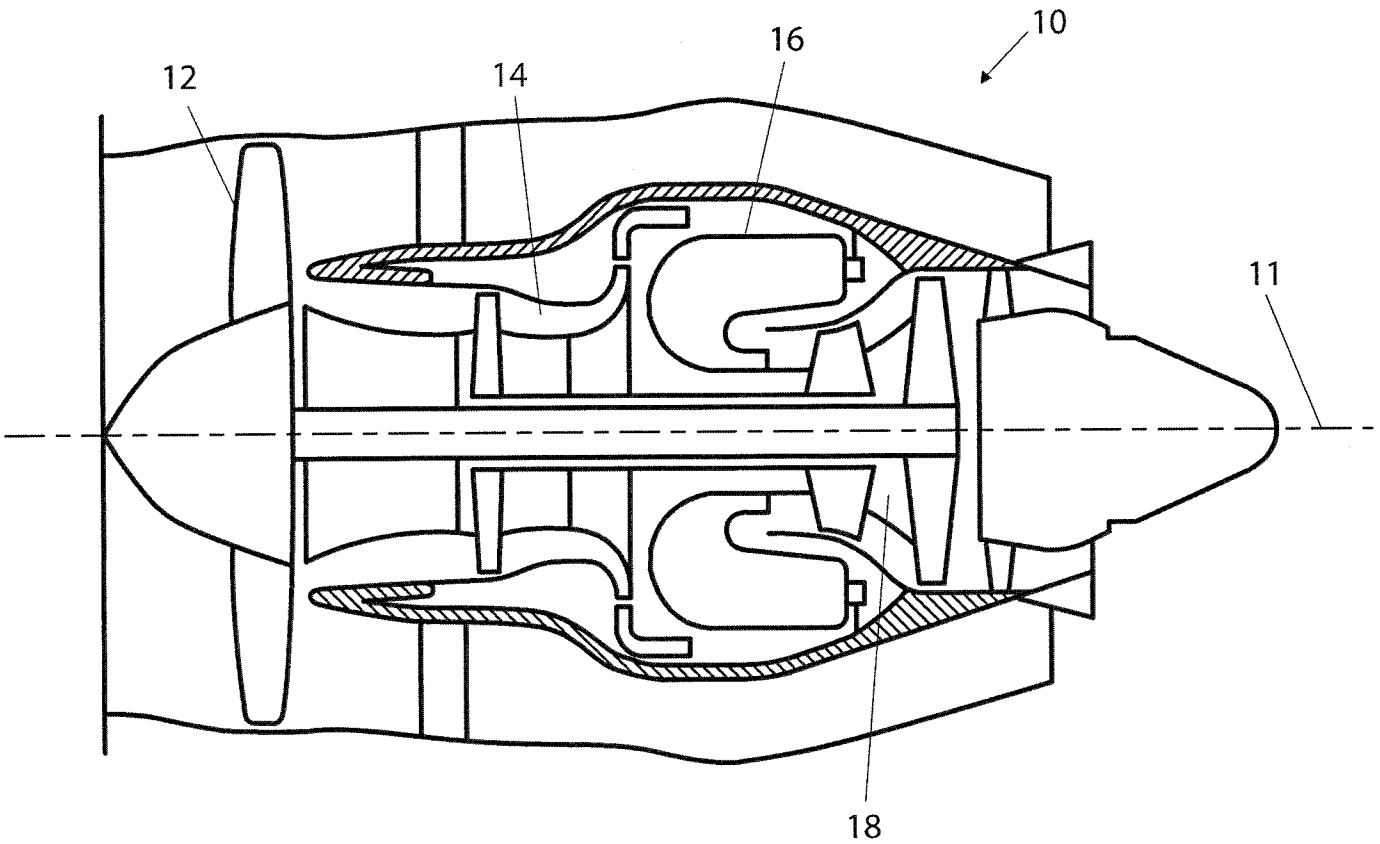
FIG. 1 is a schematic cross-sectional view of a gas turbine engine illustrating the multishaft configuration.

FIG. 1 illustrates a gas turbine engine 10 which is taken as an exemplary application of the described subject matter. The gas turbine engine 10 generally comprises in serial flow communication, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Rotors of the respective fan 12, compressor section 14 and turbine section 18, rotate about an engine axis 11.

Figure 2A:
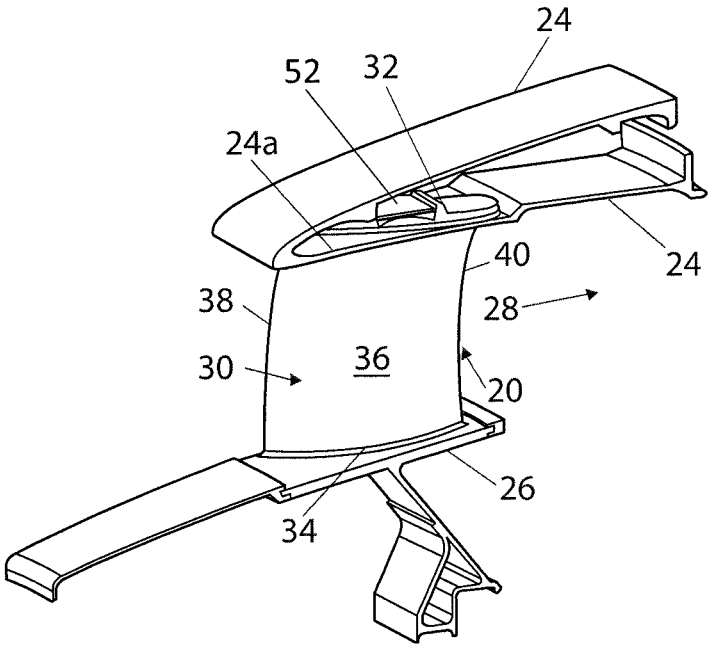
FIG. 2*a* is a fragmented perspective view showing a detail of a first embodiment.
Figure 2B:
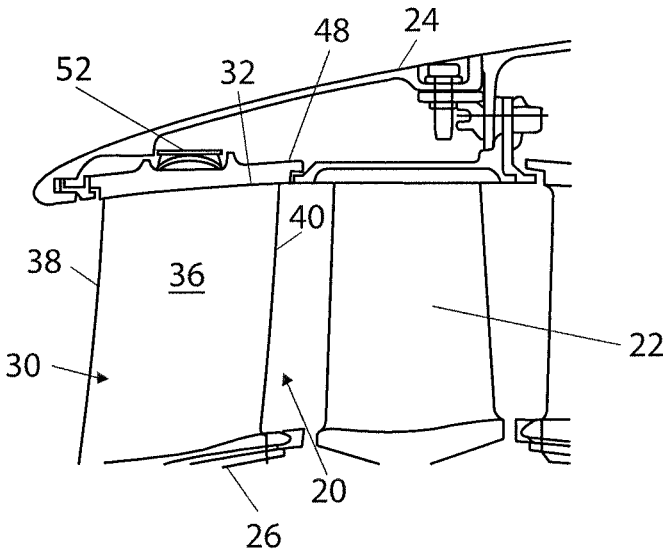
FIG. 2*b* is a fragmented side elevation of the detail shown in FIG. 2*a;*

Referring to FIGS. 2*a* and 2*b*, a rotor assembly, which can be, for example, the fan 12 or a low pressure compressor of the compressor section 14 (both shown in FIG. 1), includes rotor blades 22, which are surrounded by an engine casing 24. The casing 24 includes a tubular wall portion 24*a* extending downstream of the blades 22 to form part of a vane assembly 20. The vane assembly 20 comprises an inner shroud 26 concentric with the casing 24 and located upstream of the rotating blades 22. The inner shroud 26 and casing 24, in combination, define the annular gas flow path 28 there-between. A plurality of vanes 30 extend radially between the outer casing 24 and the inner shroud 26, upstream of the rotor blades 22. Each of the vanes 30 has a radial, outer end portion forming a vane root 32 retained in the wall 24*a* of casing 24, a radial inner end forming a vane tip 34 retained in the inner shroud 26, and an airfoil portion 36 extending therebetween. The airfoil portion 36 of each vane 30 defines a relatively sharp leading edge 38 and a relatively sharp trailing edge 40, such that an airflow passing through the vane assembly 20 will flow over the vane airfoil 36 from the leading edge 38 to the trailing edge 40.

Throughout this description, the axial, radial and circumferential directions are defined respectively with respect to the central axis 11, radius and circumference of the engine 10.

Figure 3A:
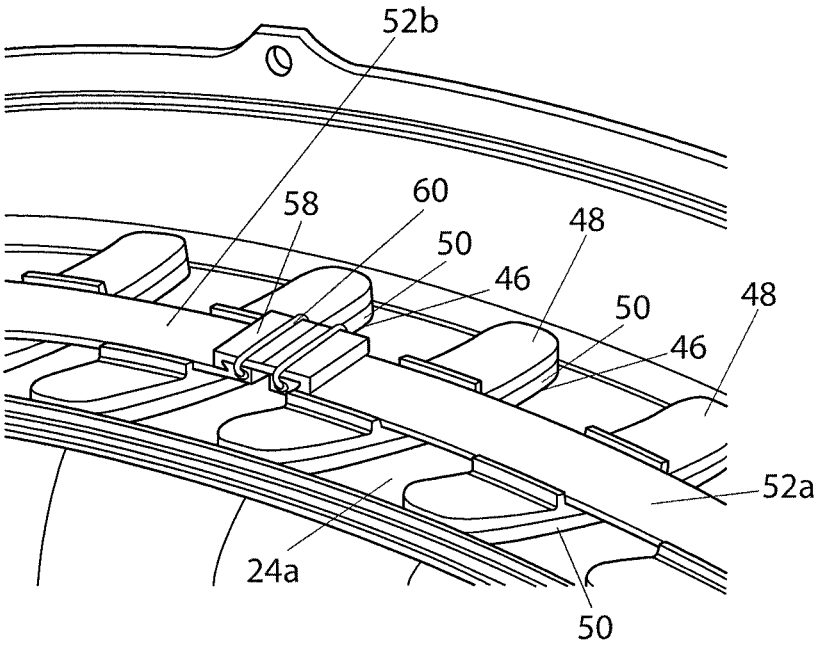
FIG. 3*a* is a fragmented perspective view of a detail of another embodiment.
Figure 3B:
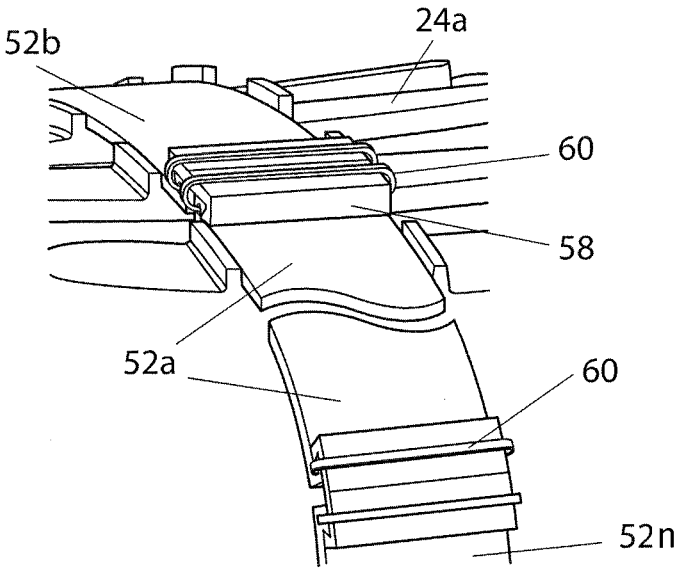
FIG. 3*b* is an expanded, fragmented, perspective view of the detail shown in FIG. 3*a;*

As shown in FIGS. 3*a*, 3*b*, the outer casing 24 has a series of circumferentially spaced openings 46 defined, for example through the wall portion 24*a* of casing 24. Each of the openings 46 has a profile similar to but slightly larger than the vane root 32 such that the vane root 32 is loosely received in the opening 46 and radially and outwardly projects from the outer surface of the outer casing 24.

The vane root 32 includes an end platform 48 having a dimension greater than a dimension of the corresponding opening 46 defined in the casing 24. A plurality of grommets 50 may be provided according to one embodiment, each grommet 50 sealing a gap between the outer platform portion 48 of one vane 30 and a corresponding opening 46. The grommet 50 may be for example, an oblong elastic ring having an L-shaped cross-section with one leg inserted into the gap between the vane root 32 and a periphery of the opening 46 in the outer casing 24, and with the other leg placed between an outer surface of the outer casing 24 and an inner surface of the end platform 48 of the vane 30.

Figure 4:
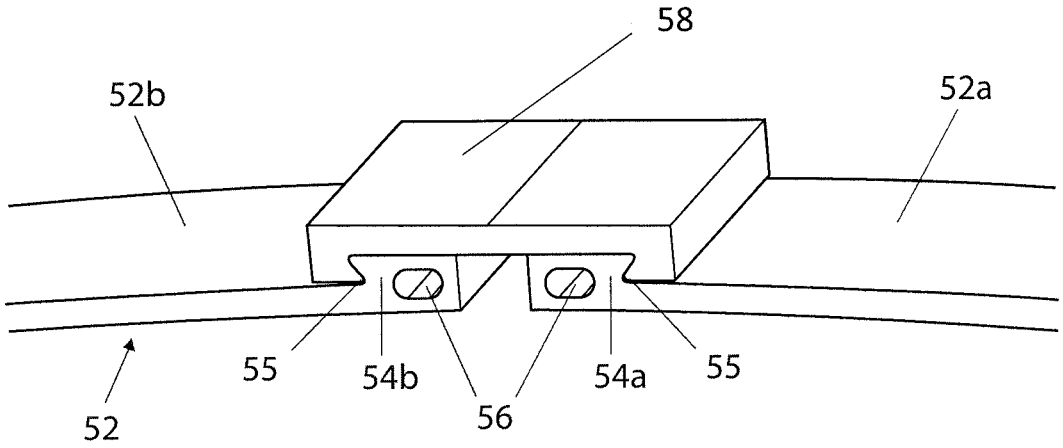
FIG. 4 is an enlarged, fragmented, perspective view of the detail shown in FIGS. 3*a*, 3*b;*

Referring to FIGS. 3*a*, 3*b* and 4, there is shown a segmented flexible ring or strap 52. The strap 52 is made up of segments 52*a*, 52*b* . . . 52*n*. The end of each segment 52*a*, 52*b* or 52*n* includes a bead 54*a*, 54*b* respectively. Each bead 54*a* and 54*b*, as shown in FIG. 4, includes an eyelet 56. The beads 54*a* and 54*b* each have a reverse-angled notch 55 to accommodate a clasp 58. In order to lock the clasp 58 in place, spring-type, C-shaped wires 60 are provided, as shown in FIGS. 3*a*, 3*b*. The reverse ends of the wires 60 engage eyelets 56 to lock the clasp 58 to the segmented strap 52.

Figure 5:
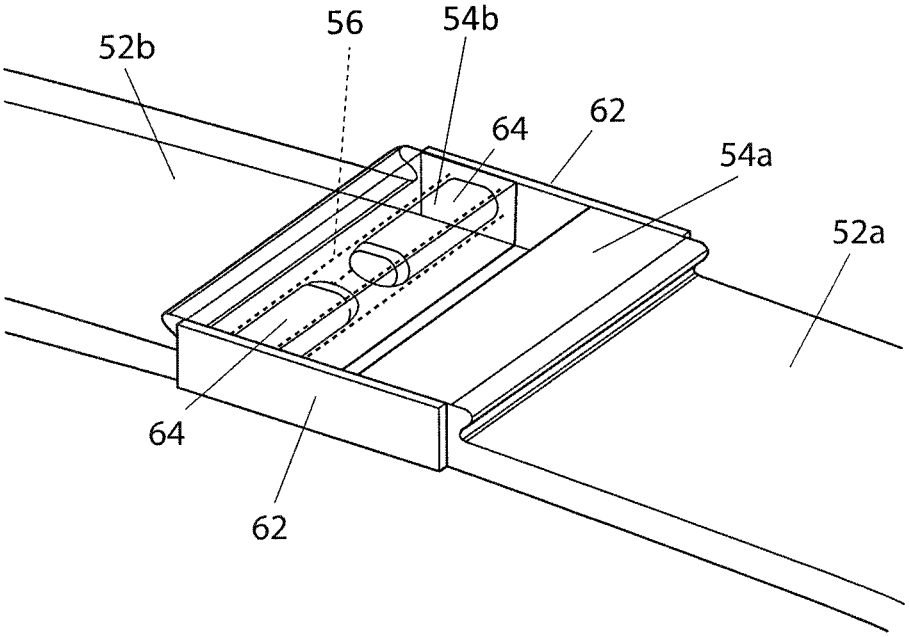
FIG. 5 is a fragmented perspective view of another embodiment of the detail shown in FIGS. 3*a*, 3*b;*

An alternative design is shown in FIG. 5. In this case, a pair of locking elements 62, each having a pair of fingers 64, perpendicular to the web of the element 62 adapted to be inserted laterally of the ends of the segmented strap 52 *a* and 52*b* into the respective eyelets 56.

Figure 6:
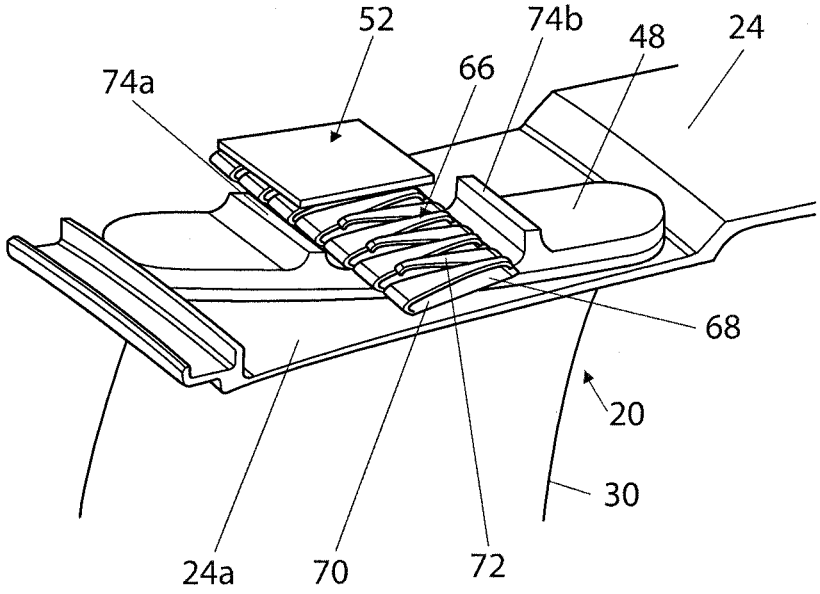
FIG. 6 is an enlarged, fragmented perspective view of a detail of the embodiment shown in FIGS. 2*a*, 2*b*.

As shown in FIG. 6, a spring strip 66 is wrapped around the vane assembly 20, represented by vane 30. The spring strip 66 is compressed and a flexible strap 52 is installed around the spring strip 66. When tooling (not shown) is removed, the spring strip 66 presses against the strap 52 and each vane 30, thus retaining the vane 30 with the required force. The spring strip 66 is made up of a continuous web 68 of spring steel, for instance, with alternating sprung fingers 70 and 72 extending laterally, each at an acute angle over the web 68. It is noted that, at the root of each spring finger 70, 72, where the stress is highest, if a crack forms and propagates, it will only affect one finger and the overall integrity of the spring strip 66 will not be significantly impacted.

Figure 7:
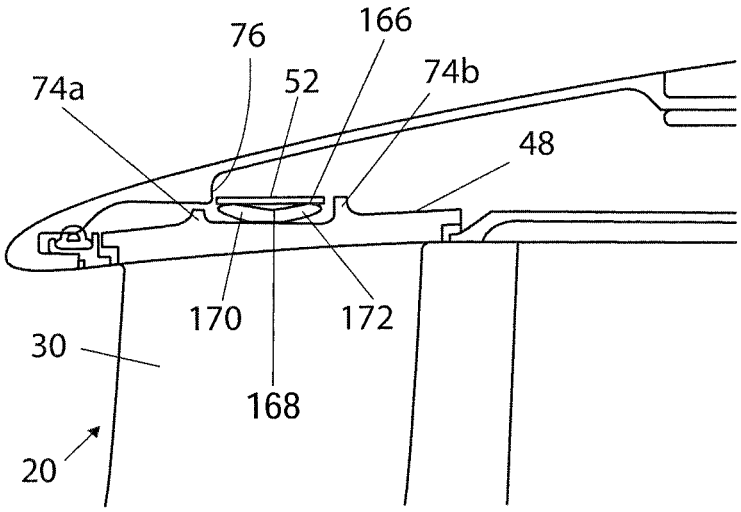
FIG. 7 is a fragmented side elevation of another embodiment of the detail shown in FIG. 6.

Alternately, the spring strip 166 could be as shown in FIG. 7 where the web 168 is spaced from the vane but the fingers 170 and 172 are in contact with the platforms of vanes 30.

In either embodiment the spring 66, 166 is retained by ridges 74*a*, 74*b* on the vane head 48 where the strap 52 is retained by the ridge 74*b* on the aft side, and a support on the splitter 76 forward thereof. Also in both of these embodiments there are two optimally spaced points of contact both on the vane assembly 20 and on the strap 52. This design feature is used to control the force distribution on the vane assembly 20 and the strap 52.

The above description is meant to be exemplary only, and one skilled in the art will recognize that changes may be made to the embodiments described without departing from the scope of the described subject matter. For example, the fingers 170 and 172 in FIG. 7 may be replaced by two continuous webs integrated with the continuous web 68 of spring steel. The two continuous webs each have a wedge smaller than ½ of the width of the continuous web 68 of spring steel and provide a radial spring function similar to that of the fingers 170 and 172. Still other modifications which fall within the scope of the described subject matter will be apparent to those skilled in the art, in light of a review of this disclosure, and such modifications are intended to fall within the appended claims.

The invention claimed is:

1. A gas turbine engine having an annular casing with a series of circumferentially spaced openings defined therethrough; a plurality of vanes extending radially inwardly through respective casing openings, an outer end of the vanes projecting radially outwardly from the casing through the respective openings and located within the respective openings by grommets, and an inner end of the vanes being mounted to an inner portion of the casing; a flexible, segmented strap extending around the annular casing surrounding the projecting outer ends of the vanes; and a spring strip surrounding the plurality of vanes and positioned radially between the flexible strap and the vanes to press radially against the respective flexible strap and vanes wherein the segmented flexible strap is in the form of a plurality of segments joined end to end by clasps, and wherein the clasps each have a web portion and a securing means near each end of the web to engage a respective segment end wherein the segment end is provided with mating means to be engaged by the securing means of the clasp.

2. The gas turbine engine as defined in claim 1 wherein each segment has a laterally extending bead at each end thereof with a reverse hook formed therein for receiving the clasp.

3. The gas turbine engine as defined in claim 1 wherein each segment has a laterally extending bead at each end thereof with an eyelet extending axially thereof.

4. The gas turbine engine as defined in claim 2 wherein each bead has an eyelet extending axially thereof.

5. The gas turbine engine as defined in claim 2 wherein each clasp has a web and a reverse hook formed at each end of the web to matingly engage the reverse hooks at the beads.

6. The gas turbine engine as defined in claim 3 wherein the clasp comprises a web with bead engaging means at each end thereof and a pair of separate C-shaped spring wires adapted to engage the respective eyelets in the beads and trap the web of the clasp.

7. The gas turbine engine as defined in claim 4 wherein the clasp comprises a web and a reverse hook formed at each end of the web to matingly engage the reverse hooks at the beads and a pair of separate C-shaped spring wires adapted to engage the respective eyelets in the beads and trap the web of the clasp.

8. The gas turbine engine as defined in claim 1 wherein the spring strip comprises an elongated web in the form of a circumferential ring and a plurality of laterally extending spring fingers projecting over the web in an alternating and crossing fashion from either edge of the web.

9. A gas turbine engine having an annular casing with a series of circumferentially spaced openings defined therethrough; a plurality of vanes extending radially inwardly through respective casing openings, an outer end of the vanes projecting radially outwardly from the casing through the respective openings and located within the respective openings by grommets, and an inner end of the vanes being mounted to an inner portion of the casing; a flexible strap extending around the annular casing surrounding the projecting outer ends of the vanes; the improvement comprising a spring strip surrounding the plurality of vanes and positioned radially between the flexible strap and the vanes, the spring strip including an elongated web in the form of a circumferential ring and a plurality of laterally extending spring fingers projecting over the web in an alternating and crossing fashion from either edge of the web to press radially against the respective flexible strap and vanes.

10. The gas turbine engine as defined in claim 9 wherein the web engages the vanes while the spring fingers engage and apply tension to the flexible strap.

11. The gas turbine engine as defined in claim 9 wherein the web engages the flexible strap while the spring fingers engage the casing and the vanes.

12. A vane retention apparatus for retaining an array of radially extending stator vanes arranged and protruding from an annular casing in a gas turbine engine; comprising a flexible, segmented strap extending around the annular casing surrounding the vanes; and a spring strip surrounding the plurality of stator vanes and positioned radially between the flexible strap and the stator vanes to press against the respective flexible strap and stator vanes wherein the flexible strap is in the form of a plurality of segments joined end to end by clasps, and wherein each segment has a laterally extending bead at each end thereof with a reverse hook formed therein for receiving one of the clasps and each bead has an eyelet extending axially thereof.

13. The vane retention apparatus as defined in claim 12 wherein the clasp comprises a web and a reverse hook formed at each end of the web to matingly engage the reverse hooks at the beads and a pair of separate C-shaped spring wires adapted to engage the respective eyelets in the beads and trap the web of the clasp.

14. A vane retention apparatus for retaining an array of radially extending stator vanes arranged and protruding from an annular casing in a gas turbine engine; comprising a flexible strap extending around the annular casing surrounding the vanes; the improvement comprising a spring strip surrounding the stator vanes and positioned radially between the flexible strap and the stator vanes, the spring strip including an elongated web in the form of a circumferential ring and a plurality of laterally extending spring fingers projecting over the web in an alternating and crossing fashion from either edge of the web to press radially against the respective flexible strap and stator vanes.

15. A method of retaining vanes in a gas turbine engine case, the case having a plurality of slots circumferentially distributed therearound, the vanes extending radially through each slot such that an end of the vane projects outwardly from the slot, the method comprising steps of placing a circumferentially continuous spring strip to surround the vane ends; placing a flexible strap made of a plurality of strap segments around the spring strip; and joining the ends of the strap segments by using respective clasps having a web portion and securing means near ends of the web portion to engage with mating means provided on the respective ends of the strap segments, to provide a continuous strap wrapped around the circumferentially continuous spring strip such that the spring strip presses radially outwardly against the flexible strap and radially inwardly against the respective vanes in position.

* * * * *